US005735718A

United States Patent [19]

Ekwall

[11] Patent Number: 5,735,718

[45] Date of Patent: Apr. 7, 1998

[54] DRIVE UNIT FOR BOATS

[75] Inventor: Ragnar Ekwall, Hisingsbacka, Sweden

[73] Assignee: AB Volvo Penta, Gothenburg, Sweden

[21] Appl. No.: 649,708

[22] PCT Filed: Nov. 29, 1994

[86] PCT No.: PCT/SE94/01147

§ 371 Date: May 29, 1996

§ 102(e) Date: May 29, 1996

[87] PCT Pub. No.: WO95/15282

PCT Pub. Date: Jun. 8, 1995

[30] Foreign Application Priority Data

Dec. 3, 1993 [SE] Sweden ..... 9304033

[51] Int. Cl.[6] ..... B63H 5/12

[52] U.S. Cl. ..... 440/83; 440/75

[58] Field of Search ..... 440/52, 53, 113, 440/57, 112, 111, 83, 76, 75; 248/640–643; 464/92, 93

[56] References Cited

U.S. PATENT DOCUMENTS

| | | | |
|---|---|---|---|
| 2,051,442 | 8/1936 | Geyer | 464/92 |
| 3,136,281 | 6/1964 | Kiekhaefer et al. | 440/52 |
| 4,583,953 | 4/1986 | Nakase | 440/52 |
| 4,634,391 | 1/1987 | Entringer et al. | 440/52 |
| 5,009,619 | 4/1991 | Meier . | |
| 5,465,678 | 11/1995 | Ekman | 440/53 |

FOREIGN PATENT DOCUMENTS 2 169 677 7/1986 United Kingdom .

*Primary Examiner*—Edward L. Swinehart
*Attorney, Agent, or Firm*—Young & Thompson

[57] ABSTRACT

A drive unit for a boat having an engine with a flywheel surrounded by a flywheel casing, a propeller drive housing connected to, but electrically insulated from, the flywheel casing, and an input shaft for the propeller drive housing which is driven and electrically insulated from the flywheel.

9 Claims, 1 Drawing Sheet

DRIVE UNIT FOR BOATS

BACKGROUND OF THE INVENTION

The present invention relates to a drive unit for boats, comprising an internal combustion engine with a flywheel fixed on a crank shaft and surrounded by a flywheel casing, and a propeller drive with a housing connected to said flywheel casing and an input shaft driven by said crank shaft.

In drive units of this type, for example outboard drive units, it is common to make parts of the drive unit, for example the rig, the propellers, the lower transmission housing of aluminum. Since these components are submerged in the water, it is important to see to it that measures are taken to prevent i.a. galvanic corrosion from shortening the useful life, should the parts be electrically connected to another submerged component of a metal which is more electro-positive, for example a keel of iron with stainless steel bolts which are grounded together with the engine block in a single-pole electric system. The parts of the drive unit submerged under water can be protected by known methods, i.e. by mounting a sacrificial anode on the drive, or by painting with protective paint, or by a combination of these two measures.

Another known method of avoiding galvanic corrosion on the propeller drive, e.g. a sailboat drive unit in a sailboat with an iron keel with stainless steel keel bolts, is to equip the boat with a two-pole electrical system, i.e. a system in which each electrical power consumer, such as the starting motor, the generator, the oil pressure sensor etc, is connected to the battery, via a positive and a negative conductor. The advantage of a two-pole electrical system is that the drive unit will be insulated from the rest of the electrical system and no attention must be paid to replacing the sacrificial anode or repainting with protective paint.

However, it is important that the boat owner, when installing additional equipment for example, does not modify the engine electrical system so that the engine drive units are grounded.

SUMMARY OF THE INVENTION

The purpose of the present invention is to provide a drive unit of the type described by way of introduction, which permits connecting the engine block to ground and where the electrical power consumers can thus be coupled to the battery via a single pole electrical system without risk that the submerged components of the drive will be subjected to galvanic corrosion.

This is achieved according to the invention in a drive unit in which the drive lacks electrically conducting connection to the engine.

In a preferred embodiment of the invention applied to known inboard and outboard drives with a metal transition housing, which has a flange screwed securely to a flange on the flywheel casing of the engine, and in which the input shaft of the drive can be drivingly connected to the flywheel via an elastic coupling, the screws are mounted in bushings of insulating material. Spacer elements of insulating material are arranged between the flanges and between the bolt heads and the flange of the drive housing. The flywheel is joined to the input shaft of the drive via an elastic coupling which has coupling halves which are electrically insulated from each other.

BRIEF DESCRIPTION OF THE DRAWINGS

The invention will be described in more detail with reference to examples shown in the accompanying drawings, where.

DESCRIPTION OF THE PREFERRED EMBODIMENTS

Figure 1:
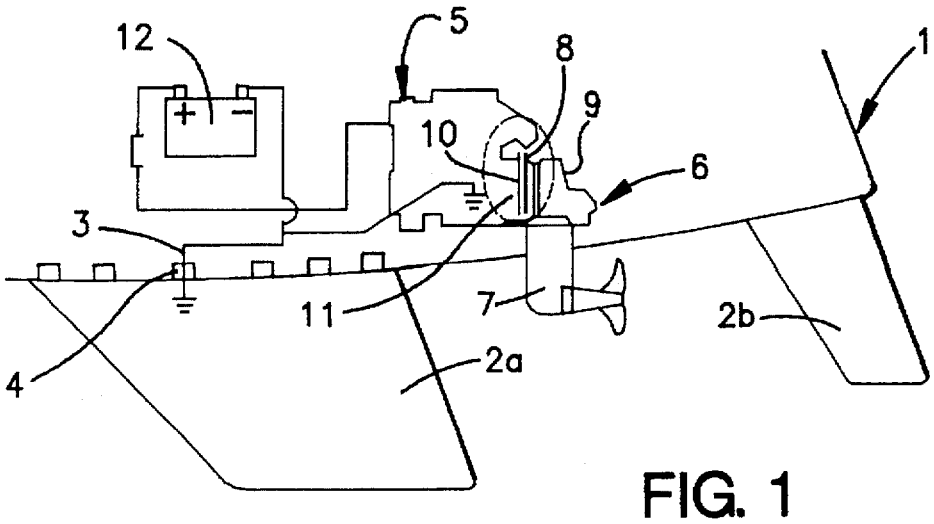
FIG. 1 shows a schematic sideview of a drive unit according to the invention in a schematically indicated sailboat hull.

The numeral 1 in FIG. 1 indicates a sailboat hull with a keel 2*a* and a rudder 2*b* spaced from each other. The keel can be made of iron or lead and have stainless steel keel bolts 3 cast therein, which are screwed fast to the inside of the hull by means of nuts 4. A drive unit consisting of an internal combustion engine 5, preferably a diesel engine, and a propeller drive 6 is bolted securely to an engine bed (not shown). The drive 6 is a so-called S-drive and has a rig leg 7 which extends out through a sealed opening in the bottom of the hull. The drive 6 is suspended in the engine 5 in a known manner by bolting a flange 8 on the upper transmission housing 9 of the drive unit to a flange 10 on the engine flywheel casing 11, as will be described in more detail with reference to FIG. 2. The engine battery 12 has its minus pole connected to keel bolt 3 and the engine block 5.

Figure 2:
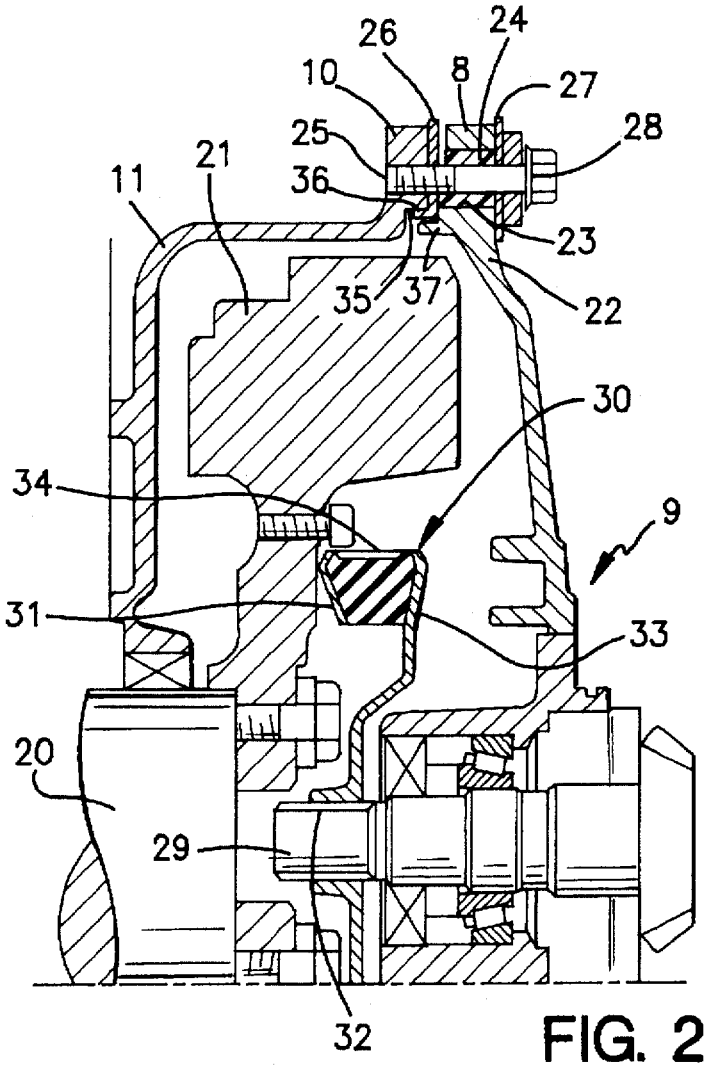
FIG. 2 shows a longitudinal section through the encircled area in FIG. 1.

The numeral 20 in FIG. 2 indicates the distal end of the engine crank shaft, to which a flywheel 21 is bolted and which is surrounded by the flywheel casing 11. The flange 8 on a wall 22 of the upper transmission housing 9 of the drive is made with a number of bores 23 into which bushings 24 of electrically insulating material, e.g. a plastics material, are forced. The flange 10 on the flywheel casing 11 has corresponding threaded bores 25. Washers 26, 27 of insulating material, e.g. a plastics material, are disposed on either side of the respective bushing 24, thus completing the electrical insulation from each other of the flywheel casing 11 and the upper transmission housing 9 of the drive, when the components are bolted 28 together.

The engine flywheel 21 is joined to an input shaft 29 to the upper transmission housing 9 of the drive, via an elastic coupling, generally designated 30, which comprises a metal ring 31 screwed securely to the flywheel 21, a metal disc 33 non-rotatably connected to said input shaft via a splines connection 32, and an intermediate ring 34 of an elastic material, e.g. rubber, which is vulcanized fast to the ring 31 and the disc 33. A groove 35 opening towards the flange 8 has a guide ring 36 of electrically insulating material, against which a guide surface on a guide shoulder 37 on the drive housing flange 8 abuts. Thus, there is no metallic connection between the ring 31 and the disc 33 nor between the flanges 8 and 10, which means that no galvanic couple can be formed with the rig leg as an anode.

The invention has been described above with reference to a propeller drive of outboard type, but of course the invention is not limited to this type of propeller drive but also comprises propeller drives of inboard type, which, although lacking a rig leg of aluminum, can protect a bronze propeller for example against corrosion by insulating the engine and the crank shaft from the shaft housing and the input shaft.

What is claimed is:

1. A drive unit for a boat, comprising:

an internal combustion engine with a flywheel fixed on a crank shaft and surrounded by a flywheel casing, a propeller drive with a drive housing connected to said flywheel casing and an input shaft driven by said crank shaft, fastening means for connecting said drive housing and said flywheel casing, electrical insulators between said drive housing and said flywheel casing, and between said fastening means and at least one of said drive housing and said flywheel casing, for establishing an electrically insulative connection between said drive housing and said flywheel casing, and a coupling connecting said input to said flywheel, said coupling comprising a further electrical insulator for electrically insulating said input shaft from said flywheel.

2. The drive unit according to claim 1, wherein said drive housing (9) has a flange (8) which is fixed to a flange (10) on said flywheel casing (11) by means of said fastening means which comprises bolts (28), and wherein said electrical insulators comprise bushings (24) and spacer elements (26, 27) of insulating material.

3. The drive unit according to claim 2, wherein said flange (8) of the drive housing has through bores (23), in which bushings (24) of insulating material for the bolts (28) are disposed and wherein said bolts extend through said spacer elements (26, 27) which are disposed on either side of said bushings.

4. The drive unit according to claim 2, wherein said flange (10) of the flywheel casing has a groove (35) opening towards said drive housing flange (8), in which groove a guide ring (36) of insulating material is disposed, and wherein said drive housing flange is provided with an axial guide shoulder (37) which has a guide surface facing said guide ring.

5. The drive unit according to claim 1, wherein said coupling (30) comprises an annular metal element (31), which is screwed securely to said flywheel (21), and a disc-shaped metal element (33), which is connected to said input shaft (29) by means of a splines connection (32), and wherein said further electrical insulator is bonded to said two metal elements.

6. The drive unit according to claim 1, wherein said propeller drive is an outboard device (6) with a rig leg (7) extended through an opening in bottom of a boat.

7. A drive unit for a boat, comprising: an engine with a flywheel surrounded by a flywheel casing;

a propeller drive housing having a first flange connected to a second flange on said flywheel casing, and an input shaft driven by and electrically insulated from said flywheel;

fastening means for connecting said first and second flanges;

electrically insulative material between said first and second flanges and between said fastening means and at least one of said first and second flanges, for establishing an electrically insulative connection between said drive housing and said flywheel casing.

8. The drive unit of claim 7, further comprising a coupling connecting said input shaft to said flywheel, said coupling comprising an electrical insulator for electrically insulating said input shaft from said flywheel.

9. The drive unit of claim 7, wherein said electrically insulative material between said first and second flanges comprises spacers and wherein said electrically insulative material between said fastening means and at least one of said first and second flanges comprises bushings and further spacers.

* * * * *